US010702924B2

(12) United States Patent
Szabo et al.

(10) Patent No.: US 10,702,924 B2
(45) Date of Patent: Jul. 7, 2020

(54) METAL POWDER AND USE THEREOF

(71) Applicant: HÖGANÄS AB (PUBL), Höganäs (SE)

(72) Inventors: Christophe Szabo, Ratingen (DE); Senad Dizdar, Höganäs (SE); Ola Bergman, Helsingborg (SE)

(73) Assignee: HÖGANÄS AB (PUBL), Höganäs (SE)

( * ) Notice: Subject to any disclaimer, the term of this patent is extended or adjusted under 35 U.S.C. 154(b) by 1411 days.

(21) Appl. No.: 14/370,704

(22) PCT Filed: Jan. 3, 2013

(86) PCT No.: PCT/EP2013/050070
§ 371 (c)(1),
(2) Date: Jul. 3, 2014

(87) PCT Pub. No.: WO2013/102650
PCT Pub. Date: Jul. 11, 2013

(65) Prior Publication Data

US 2015/0093280 A1 Apr. 2, 2015

(30) Foreign Application Priority Data

Jan. 5, 2012 (EP) ..... 12150253

(51) Int. Cl.

| | |
|---|---|
| ***B22F 5/08*** | (2006.01) |
| ***C22C 38/22*** | (2006.01) |
| ***C22C 33/02*** | (2006.01) |
| ***B22F 3/10*** | (2006.01) |
| ***B22F 1/00*** | (2006.01) |
| ***B22F 3/00*** | (2006.01) |
| ***B22F 3/02*** | (2006.01) |

(52) U.S. Cl.
CPC ..... *B22F 5/08* (2013.01); *B22F 1/007* (2013.01); *B22F 3/004* (2013.01); *B22F 3/02* (2013.01); *B22F 3/10* (2013.01); *B22F 3/1028* (2013.01); *C22C 33/0207* (2013.01); *C22C 33/0257* (2013.01); *C22C 38/22* (2013.01); *B22F 2003/023* (2013.01)

(58) Field of Classification Search
CPC ..... B22F 5/08
See application file for complete search history.

(56) References Cited

U.S. PATENT DOCUMENTS

| | | | | |
|---|---|---|---|---|
| 2,790,714 | A * | 4/1957 | Wallace | C22C 1/10 420/123 |
| 4,702,771 | A | 10/1987 | Takagi et al. | |
| 4,840,665 | A | 6/1989 | Fujii | |
| 2004/0256029 | A1 | 12/2004 | Takayama et al. | |
| 2005/0186105 | A1 | 8/2005 | Jo | |
| 2005/0238523 | A1 * | 10/2005 | Skoglund | B22F 1/0059 419/38 |
| 2005/0252338 | A1 | 11/2005 | Henmi et al. | |
| 2009/0162241 | A1 | 6/2009 | Scott et al. | |

FOREIGN PATENT DOCUMENTS

| | | | |
|---|---|---|---|
| CN | 1662327 | A | 8/2005 |
| CN | 102165083 | A | 8/2011 |
| CN | 102242304 | A | 11/2011 |
| JP | H06145916 | A | 5/1994 |
| JP | 2006233331 | A | 9/2006 |
| WO | 2008/036026 | A1 | 3/2008 |
| WO | 2009/040369 | A1 | 4/2009 |

OTHER PUBLICATIONS

International Search Report (PCT/ISA/210) dated May 17, 2013, by the European Patent Office as the International Searching Authority for International Application No. PCT/EP2013/050070.

Written Opinion (PCT/ISA/237) dated May 17, 2013, by the European Patent Office as the International Searching Authority for International Application No. PCT/EP2013/050070.

H. Danninger, "8$^{th}$ International Conference on Powder Metallurgy in ThASFR", Oct. 9, 1992, pp. 81-90.

C. Wang, "Mechanism of Sintering Densification of Fe—Cr—Mo—C Powder Compact", Zhongnan Daxue Xuebao, Apr. 30, 1998, pp. 153-156, vol. 29, No. 2.

Dobrzanski L.A. et al."Effect of cooling rates on sinter-hardened steels" Copyright by International OCSCO World Press. All rights reserved., vol. 37, Issue 2, Dec. 2009, pp. 630-638.

Search Report Completed dated Jun. 29, 2018 by the Taiwanese Patent Office in corresponding ROC Taiwan Patent Application No. 102100128, 1 page. (English translation only).

Office Action (English Version of the Unfavorable Opinion) dated Dec. 27, 2018, by the Brazilian Patent Office in corresponding Brazilian Patent Application No. BR112014016443-6, English Translation only. (3 pages).

Office Action (Translation of Office Action) dated Sep. 20, 2016, by the Japanese Patent Office in corresponding Japanese Patent Application No. 2014-550703, and an English Translation of the Office Action. (7 pages).

Office Action (Translation of Office Action) dated Dec. 27, 2016, by the Japanese Patent Office in corresponding Japanese Patent Application No. 2014-550703, and an English Translation of the Office Action. (8 pages).

Office Action (Translation of Office Action) dated Feb. 23, 2017, by the Japanese Patent Office in corresponding Japanese Patent Application No. 2014-550703, and an English Translation of the Office Action. (6 pages).

Office Action (Text of the First Office Action) dated Jun. 16, 2015 by the State Intellectual Property Office of the People's Republic of China in corresponding Chinese Patent Application No. 201380004881.8, and an English Translation of the Office Action. (12 pages).

(Continued)

*Primary Examiner* — Christopher S Kessler
(74) *Attorney, Agent, or Firm* — Buchanan Ingersoll & Rooney P.C.

(57) ABSTRACT

A material which can be used to manufacture components which exhibit high strength and high wear resistance, at the same time possessing reasonable ductility. The material also has cost advantages compared to other potential metal powder solutions. An iron based powder composition which achieves desired microstructure/properties and associated sliding wear resistance with reduced content of expensive alloying ingredients such as admixed elemental Ni and Copper.

7 Claims, 7 Drawing Sheets

(56) References Cited

OTHER PUBLICATIONS

Partial European Search Report Completed on Oct. 2, 2012 by the European Patent Office in corresponding European Patent Application No. 12150253, 1 page.
Office Action dated Oct. 6, 2016 by the European Patent Office in corresponding European Patent Application No. 12150253, 3 pages.
Office Action dated Sep. 6, 2017 by the European Patent Office in corresponding European Patent Application No. 12150253, 3 pages.
Office Action dated Sep. 7, 2018 by the European Patent Office in corresponding European Patent Application No. 12150253, 4 pages.
Office Action (Translation of Office Action) dated Sep. 30 2019, by the Korean Patent Office in corresponding Korean Patent Application No. 10-2014-7021924, and an English Translation of the Office Action. (7 pages).
Office Action (Text of the First Office Action) dated Apr. 13, 2016 by the State Intellectual Property Office of the People's Republic of China in corresponding Chinese Patent Application No. 201380004881.8, and an English Translation of the Office Action. (7 pages).
Hrubovčáková, M. et al."Influence of Carbon Content on Oxides' Reduction During Sintering of Cr-Mo-C Prealloyed Steel" Powder Metallurgy Progress, vol.11 No. 1-2, 2011, pp. 115-122.

* cited by examiner

METAL POWDER AND USE THEREOF

CROSS REFERENCE TO RELATED APPLICATIONS

The present application is a U.S. National Stage of International Application No. PCT/EP2013/050070, filed on Jan. 3, 2013, which claims the benefit of European Application No. 12150253.8, filed on Jan. 5, 2012. The entire contents of each of International Application No. PCT/EP2013/050070 and European Application No. 12150253.8 are hereby incorporated herein by reference in their entirety.

SUMMARY

The disclosure concerns the field of powder metallurgy and components which can be manufactured by metal powders. Such components may be as engine components.

BACKGROUND

In industries the use of metal products manufacturing by compaction and sintering metal powder compositions is becoming increasingly widespread. A number of different products of varying shape and thickness are being produced and the quality requirements are continuously raised at the same time as it is desired to reduce the cost. As net shape components, or near net shape components requiring a minimum of machining in order to reach finished shape, are obtained by press and sintering of iron powder compositions in combination with a high degree of material utilisation, this technique has a great advantage over conventional techniques for forming metal parts such as moulding or machining from bar stock or forgings.

US52009/0162241 describes a metal powder useful for manufacturing gears. For many applications, a high wear resistance and hardness of the final product is desired. These properties are often difficult to combine with yet another desirable property, i.e. ductility, and there is a need in the industry to have access to easily produced components which will exhibit the same, or similar, mechanical properties as components made from wrought or cast iron.

There is also a desire to keep costs as low as possible while maintaining the above beneficial properties.

SUMMARY

The disclosure provides a material which can be used to manufacture components which exhibit high strength and high wear resistance, at the same time possessing reasonable ductility. The material also has cost advantages compared to other potential metal powder solutions.

The disclosure provides an iron based powder composition which achieves desired microstructure/properties and associated sliding wear resistance with reduced content of expensive alloying ingredients such as admixed elemental Ni and Copper.

The constituent ingredients demonstrate sufficient hardenability to achieve martensitic transformation at cooling rates attainable in conventional furnaces thereby leveraging existing installed capacity and deferring capital investment in specialized furnaces. By using the powder according to the disclosure, it is also possible to avoid the sometimes negative dimensional distortion associated with rapid quenching by oil baths and/or gas pressure quenching. The material shows sufficient formability to achieve a high degree of dimensional accuracy required of net-shape sintered articles. Forming may be performed without supplemental part heating, tool heating, intermediate quenching and thereby avoids the associated operational complexity and cost of warm/hot forming processes.

BRIEF DESCRIPTION OF THE DRAWINGS

Embodiments of the disclosure will be apparent in view of the following Figures.

DETAILED DESCRIPTION

Figure 1:
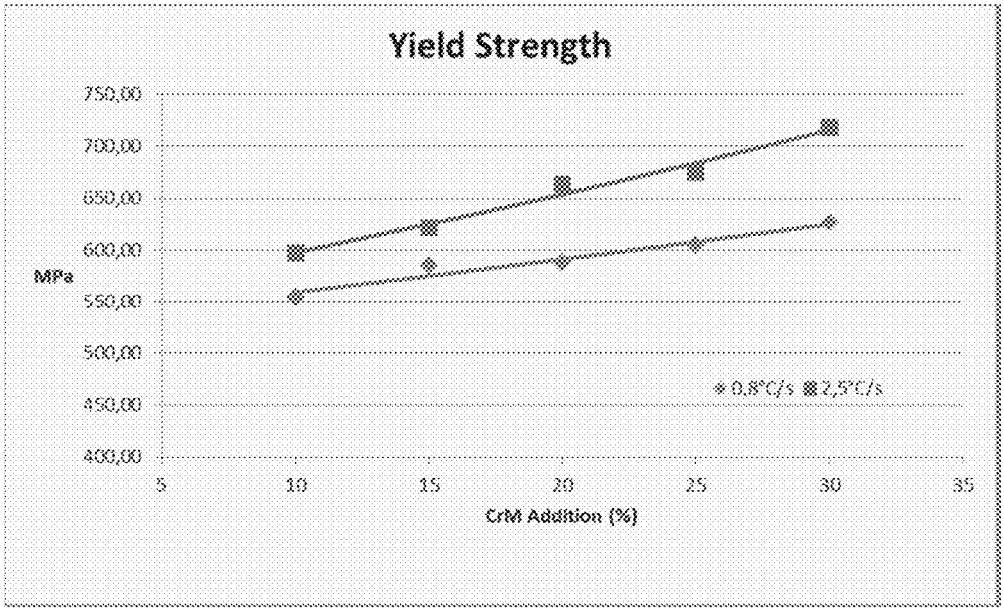
FIG. 1 indicates changes in yield strength.

The disclosure provides a powder mixture consisting of iron based powder A and iron based powder B in a ratio between 90:10 and 50:50, wherein powder A contains 1.5-2.3wt % or preferably 1.7-1.9wt % pre-alloyed Cr, 0-0.35 wt % pre-alloyed Mo, and inevitable impurities, the balance being Fe; powder B contains 2.4-3.6wt % or preferably 2.8-3.2wt % pre-alloyed Cr, 0.30-0.70wt % or preferably 0.45-0.55 wt % pre-alloyed Mo and inevitable impurities, the balance being Fe; the powder mixture further containing 0.4-0.9 wt % carbon, 0.1-1.2 wt % lubricant such as LUBE E®, KENOLUBE®, obtainable from Höganäs AB, Höganäs, Sweden, or waxes derived from the EBS group such as amidewax, solid lubricant such as CaF2, $MgSiO_3$, MnS, $MoS_2$, or $WS_2$, in an amount of 0.1-1.5wt %., and inevitable impurities. The solid lubricant is preferably MnS.

Said ratio between iron based powder A and iron based powder B is preferably between 80:20 and 60:40, or between 70:30 and 60:40. Preferably, said ratio is 65:35.

In a further embodiment, the disclosure provides as method of manufacturing a sintered component comprising the steps of:

a) providing a powder mixture as defined above;

b) placing said mixture in a mold;

c) subjecting said powder in said mold to a pressure between 300 and 1200 or between 400 and 800 or between 600 and 800 MPa at a temperature between 20° C. and 130° C. to form a green body;

d) sintering said green body at a temperature of between 1100 and 1300° C. to form a sintered body; and e) cooling said sintered body at a rate above 0.5° C./second to form a sintered component.

Step c) is preferably performed at 75° C.

Step d) and/or e) is preferably performed under an atmosphere with partial oxygen pressure of $10^{-17}$ atm, for example in a 90% $N_2$:10% $H_2$ atmosphere.

The disclosure further provides a sintered component manufactured by said method. Such a sintered component contains fine Pearlite having a microhardness (mhv0.1) of at least 280, or preferably at least 340. Said sintered component may be composed of a fine pearlitic matrix characterized by a high wear resistance into which martensite is dispersed in a range of 20-60% percent of the total area of a cross section. Said martensite exhibits a micro Vickers hardness (mhv) of at least 650, or higher, such as 850 to 950 mainly depending on dissolved carbon content.

In one embodiment, the sintered component is a cam lobe. Other applications of interest are sprockets, lobes, gears, e.g., oil pump gears, or any other structural part requiring a combination of wear resistance, Hertzian pressure elongation in combination with good mechanical properties.

EXAMPLES

Example 1

Powder mixtures consisting of iron based powder A and iron based powder B in different ratios according to table 1, were prepared. To all mixtures, 0.75 wt % graphite, UF4, 0.6 wt % lubricant Lube E®, and solid lubricant 0.50 wt % MnS were added.

TABLE 1

| Sample | 1 | 2 | 3 | 4 | 5 |
|---|---|---|---|---|---|
| Powder A | 90 | 85 | 80 | 75 | 70 |
| Powder B | 10 | 15 | 20 | 25 | 30 |

Figure 2:
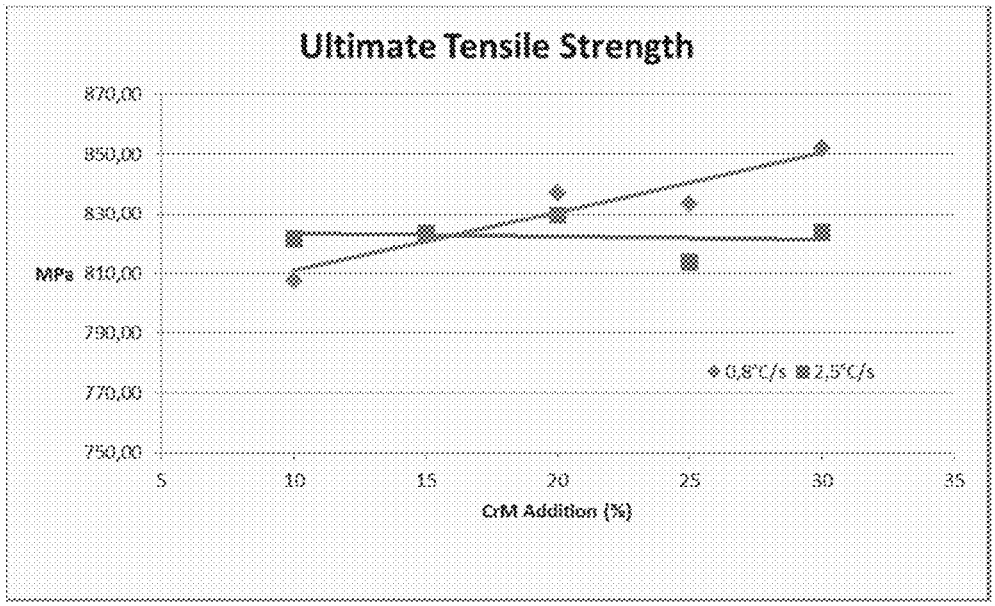
FIG. 2 indicates changes in tensile Tensile strength.
Figure 3:
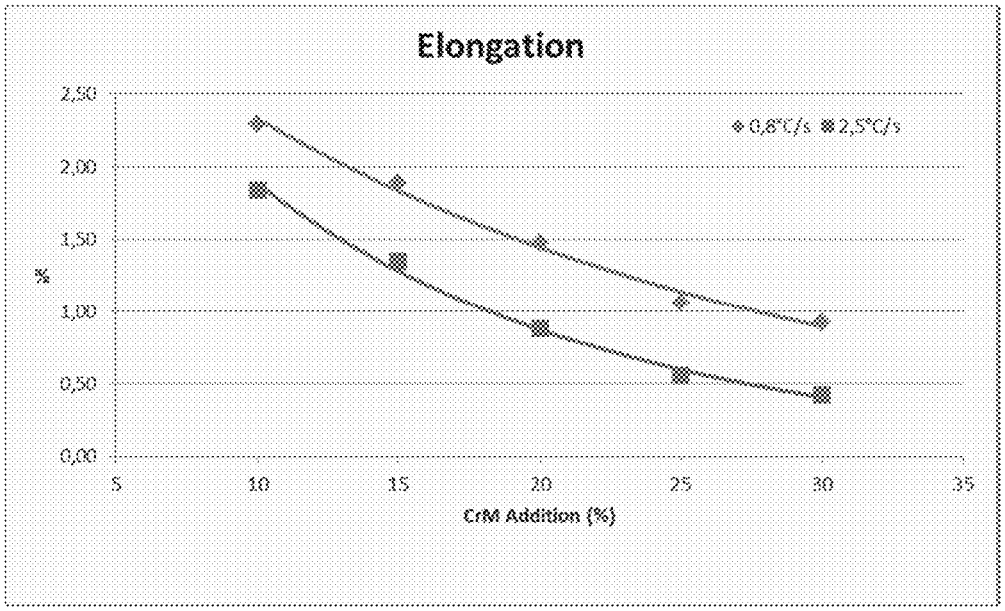
FIG. 3 indicates changes in elongation.

Each mix was placed in a mould, and compacted at 700 MPa via WDC at 75° C. to produce test specimens. The test specimens were sintered at 1120° C. for 30 minutes in 90/10 $N_2H_2$ with cooling at either 0.8° C./second or 2.5° C./second. The specimens were tested for yield strength (YS), ultimate tensile strength (UTS), and elongation (A %). Results are shown in FIGS. 1-3.

As can be seen from the results the addition of Powder B to Powder A with or without increased cooling rate provide gains in Yield Strength and some decrease of the elongation of the material. Additions of Powder B also showed increased Ultimate tensile strength at the lower cooling rate of 0.8° C./s. However, at the higher cooling rate, 2.5° C./s, the addition of Powder B did not have any effect on the UTS of the material no matter the amount of Powder B added.

Figure 4:
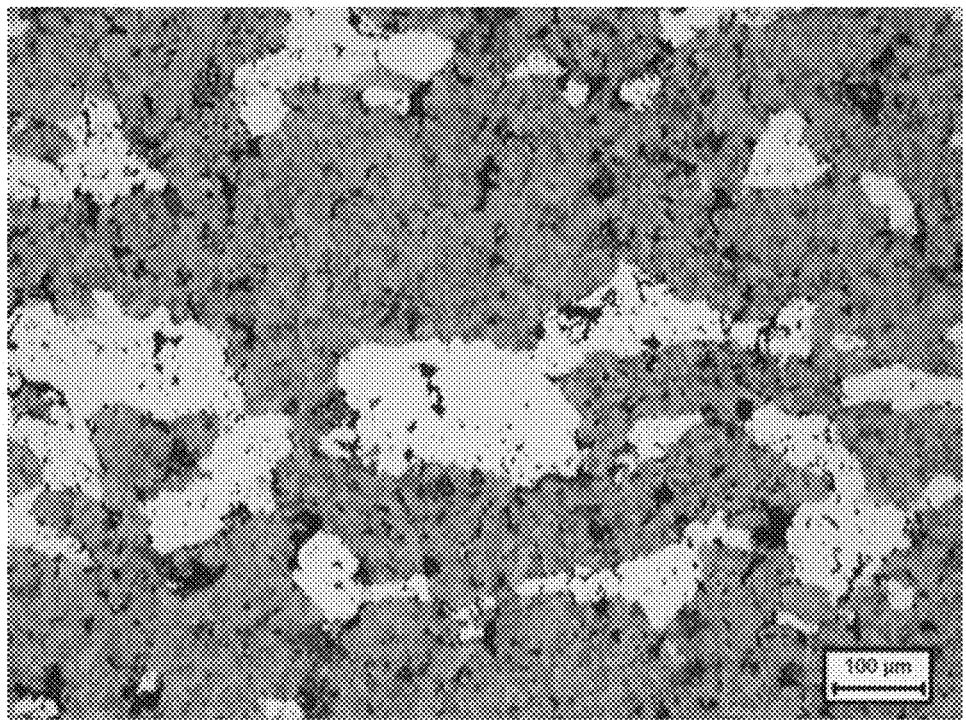
FIG. 4 indicates the microstructure obtained for material consisting of 80% powder A and 20% of powder B.

The microstructure obtained for the material 3 consisting of 80% of powder A and 20% of powder B is shown in FIG. 4. The microstructure consists of a fine pearlitic matrix into which martensite is dispersed in about 25%.

Example 2

A first characterization of wear behavior or sintered steels may focus on wear transitions in sliding lubricated contacts since a majority of structural components in machinery have a function relying on sliding movements.

Figure 5:
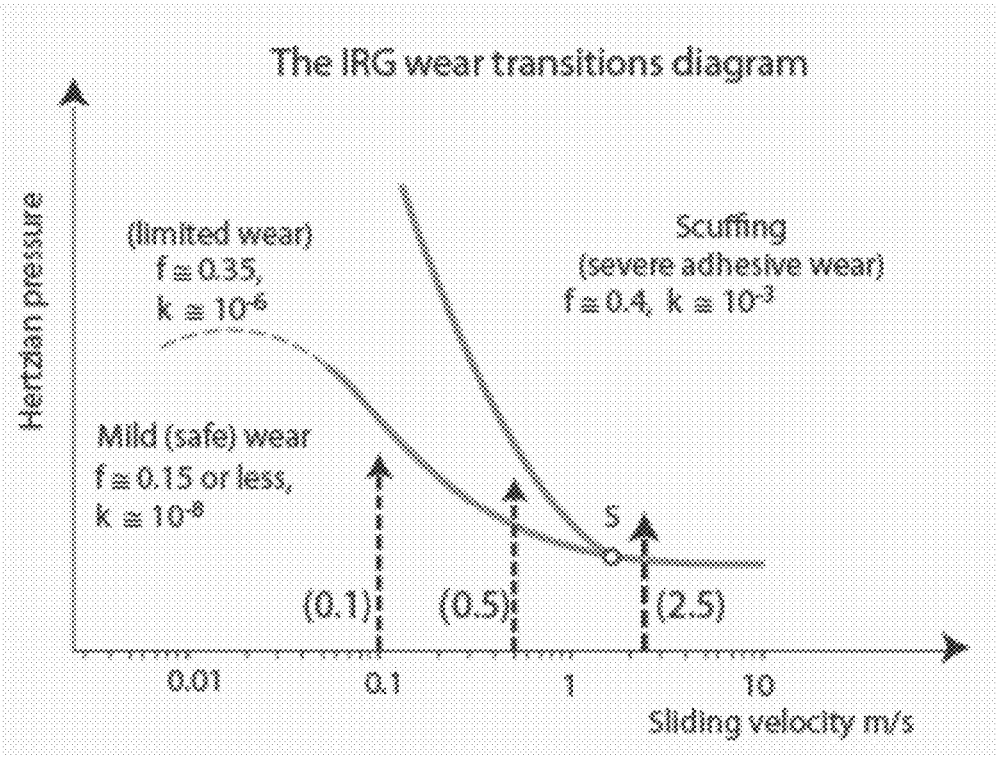
FIG. 5 indicates principal IRG wear transitions diagram depicting a general wear characterization of sliding lubrication contacts.

FIG. 5 shows a principal IRG wear transition diagram with test velocities used in this example.

The diagram is a very useful tool and a main result of scientific co-operation inside International Research Group on Wear of Materials (IRG-WOEM) in 1970' supported by OECD, provides a readable example of the IRG wear transition diagram usage in CVT development. Wear testing in this investigation is performed at three sliding velocities, 0.1 (low), 0.5 relatively high) and 2.5 m/s (high) having a standard engine oil at 90° C. as lubricant. At 2.5 m/s, the high sliding velocity combined with enough high load is expected to cause a sudden transition from mild/safe wear to severe wear/scuffing. Here, testing is performed by a stepwise in-creasing Hertzian pressure until scuffing occurs. At 0.1 m/s and 0.5 m/s the wear process is expected to intensify gradually with increase in load and to reduce total number of test runs.

Figure 6:
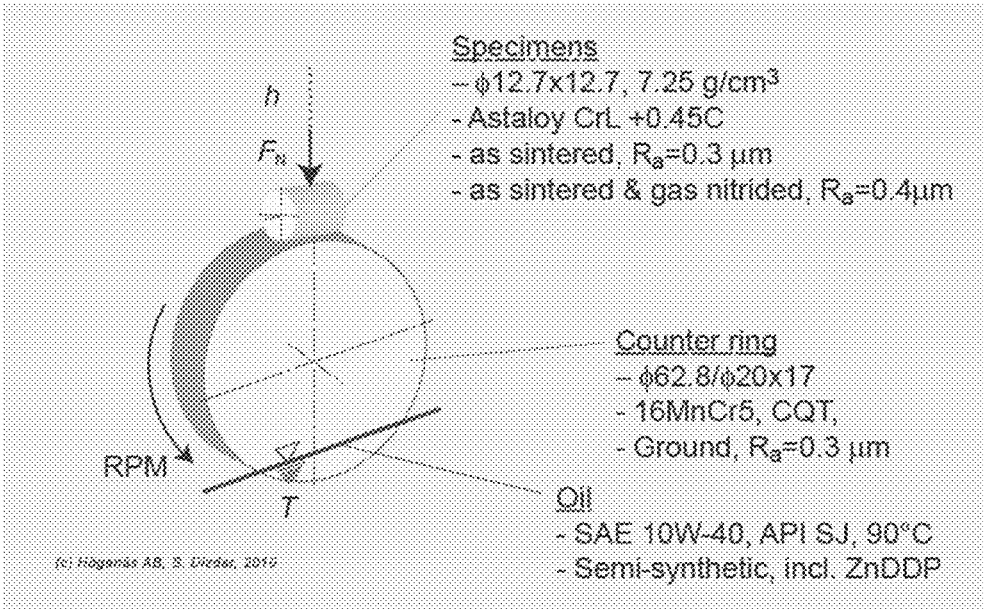
FIG. 6 indicates crossed cylinder test setup.

Testing was performed at nominal Hertzian pressure at the test start of 500 and 800 MPa at sliding velocities of 0.1 and 0.5 m/s. At 2.5 m/s the testing was performed by gradually increasing loading. The wear testing was done by using a commercial tribometer, a multipurpose friction and wear measuring machine with crossed cylinders test set-up, according to FIG. 6.

Figure 7:
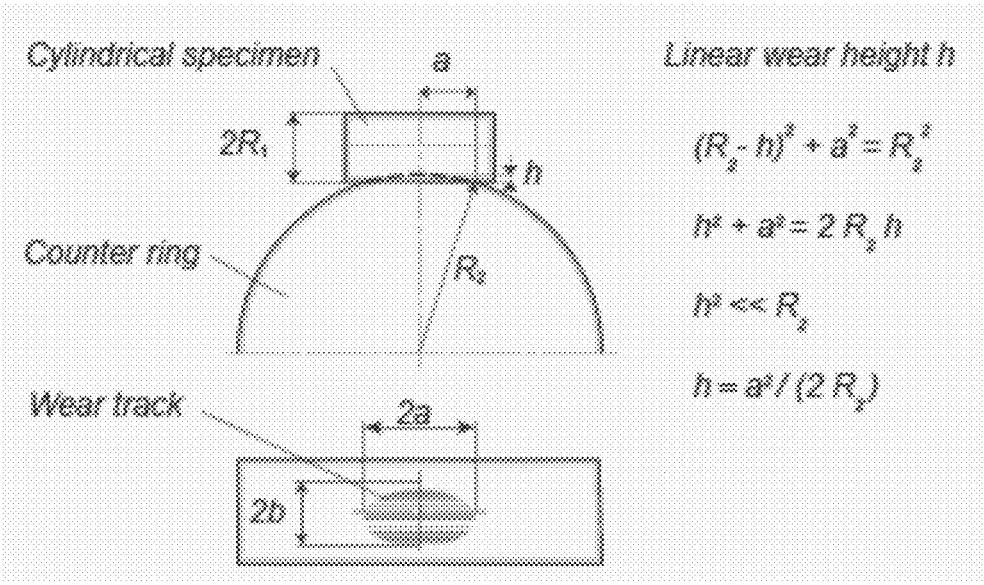
FIG. 7 indicates calculation of linear wear, h, for crossed cylinders contact.

The tribometer applies normal load on the cylinder specimen holder by dead weights/load arm while an AC thyristor controlled motor drives the counter ring. The counter ring is immersed in an oil bath with approx. 25 ml oil and option for heating up to 150° C. A PC controls the test and logs linear displacement in the contact, wear, friction force, and oil temperature. The linear displacement acquired is about three times larger than the linear wear over the wear track, since the displacement transducer is placed not over the test cylinder but on the load arm lever. The logged value is therefore a proportional value and need to be backward calculated based on linear wear h of the cylinder sample at the end of a test run determined by light optical microscope FIG. 7.

The results of the performed test runs are listed in Table 2. The reference specimens of cast iron material failed at 1200 MPa in the beginning of the test. At 1100 MPa, the sliding was considered wear-safe.

Sintered specimens experienced safe wear from 900 to 1100 MPa. Exceeding 1100 MPa, the COF decreased steadily from 0.11 to 0.06-level. The reason for this is likely due to movement of MnS granules from the surface into the lubricating oil, where the granules build a lubricating suspension. MnS acts here as a so called friction modifier.

TABLE 2

Results of wear testing

| Herzian | Sliding | Embodiment of Disclosure | | Reference | |
|---|---|---|---|---|---|
| pressures (MPa) | velocity (m/s) | Coefficient of friction | Wear | Coefficient of friction | Wear |
| 1300 | 2.5 | 0.07 | Severe | — | — |
| 1200 | 2.5 | 0.09 | Severe | 0.35 | Severe |
| 1100 | 2.5 | 0.10 | Safe | 0.09 | Safe |
| 1000 | 2.5 | 0.11 | Safe | — | — |
| 900 | 2.5 | 0.08 | Safe | — | — |
| 800 | 0.5 | 0.011 | Safe | 0.17 | Safe |

The invention claimed is:

1. A powder mixture consisting of:

iron based powder A;

iron based powder B in a ratio between 90:10 and 50:50;

0.4-0.9 wt % carbon;

0.1-1.2 wt % lubricant;

solid lubricant in an amount of 0.1-1.5 wt %; and inevitable impurities, wherein powder A contains 1.5-2.3 wt % pre-alloyed Cr, 0-0.3 wt % pre-alloyed Mo, and inevitable impurities, the balance being Fe;

wherein powder B contains 2.4-3.6 wt % pre alloyed Cr, 0.30-0.70 wt % pre-alloyed Mo and inevitable impurities, the balance being Fe.

2. Powder mixture according to claim 1, wherein said ratio is between 80:20 and 60:40.

3. Powder mixture according to claim 1, wherein the pre-alloyed Cr content in powder A is 1.7-1.9 wt %.

4. Powder mixture according to claim 1, wherein the pre-alloyed Cr content in powder B is 2.8-3.2 wt %.

5. Powder mixture according to claim 1, wherein the solid lubricant is at least one chosen from the group consisting of CaF2, $MgSiO_3$, MnS, $MoS_2$, and $WS_2$.

6. A method of manufacturing a sintered component comprising the steps of:

a) providing a powder mixture as defined in claim 1;

b) placing said mixture in a mold;

c) subjecting said powder in said mold to a pressure between 300 and 1200 MPa at a temperature between 20° C. and 130° C. to form a green body;

d) sintering said green body at a temperature of between 1100 and 1300° C. to form a sintered body;

e) cooling said sintered body at a rate above 0.5° C./second to form a sintered component.

7. Method according to claim 6, wherein step d) and/or e) is performed under an atmosphere with partial oxygen pressure of $10^{-17}$ atm.

* * * * *